US005248287A

United States Patent [19]

Nicoletti

[11] Patent Number: 5,248,287

[45] Date of Patent: Sep. 28, 1993

[54] EXERCISE DEVICE

[75] Inventor: Anthony Nicoletti, 26 Columbia Ter. Apt. #19, Edgewater, N.J. 07020

[73] Assignee: Anthony Nicoletti, Edgewater, N.J.

[21] Appl. No.: 866,000

[22] Filed: Apr. 9, 1992

[51] Int. Cl.[5] ..... A63B 21/075

[52] U.S. Cl. ..... 482/106; 482/140

[58] Field of Search ..... 482/148, 93, 100, 101, 482/106, 140

[56] References Cited

U.S. PATENT DOCUMENTS

| | | | |
|---|---|---|---|
| 4,274,628 | 6/1981 | Hoogland | 482/106 |
| 4,720,096 | 1/1988 | Rogers | 482/106 |
| 4,765,612 | 8/1988 | Henry | 482/93 |
| 4,863,158 | 9/1989 | Tassone | 482/106 |
| 4,872,667 | 10/1989 | Favot | 482/106 |
| 4,949,951 | 8/1990 | Deola | 482/100 |

*Primary Examiner*—Stephen R. Crow

*Attorney, Agent, or Firm*—Elliot M. Olstein; William Squire

[57] ABSTRACT

An exercise device for facilitating trunk rotation exercises has a semicircular shaped elongated member with handles at each end of the member. The handles extend toward each other across the front of the user and forces the user's hands to be located close to the upper torso of the body when the inner curvature of the device is held against the back across or near the shoulder blades.

7 Claims, 3 Drawing Sheets

EXERCISE DEVICE

The present invention relates to an exercise device and, more particularly, to a cross resistance exercise device in which alternate compression and tension is produced in abdominal and oblique muscles to thereby exercise these muscles and to concomitantly reduce the waist line.

BACKGROUND OF THE INVENTION

A wide variety of exercises are known which create so-called cross resistance in selected muscles and which particularly produce alternating compression and tension in the abdominal muscles and the oblique muscles for the strengthening thereof and to reduce the waist line. The simplest form of such an exercise is the so-called torso or waist twist.

In performing this exercise, the exerciser may either extend the arms straight out or more may bend the arms at the elbows locking the hands together at the rear of the neck or head. In either event, the exerciser firmly plants the feet on the floor and begins to alternately twist the upper torso clockwise and counterclockwise. As a result of this alternate twisting, abdominal and oblique muscles on one side of the body compress, thus "pulling" the torso in one rotational direction, while the muscles on the other side are extended by this rotational action. Upon rotation stopping, the exerciser rotates in the opposite direction thus reversing the compressive and tensile effects on the affected muscle groups.

The effects of the above exercise may be accentuated, for example, by beginning the twisting action with the arms bent and the hands locked behind the head and by subsequently fully stretching the arms outwardly. This later action has the effect of increasing the rotative inertia of the exerciser, thereby requiring more force to both start and to stop the rotating action.

Along these lines, those engaged in exercise and weight lifting have for many years known that the addition of mass to the upper torso can further increase the force necessary to start and stop twisting. Such force addition has been achieved in the past by, for example, the exerciser carrying on the shoulders, and maintaining in place with the hands, an elongated member such as a broomstick, pole or weight lifting bar. See, for example, U.S. Pat. Nos. 4,518,162 and 4,770,414. These two patents illustrate more or less straight bars similar to poles or weight bars which contain a variety of padding and weight-varying adjustments. In both of these patents the exercise bars are essentially straight with the user grasping them at or near their ends with the hands of the outstretched arms.

The bar of the above mentioned U.S. Pat. No. 4,770,414 while essentially straight may include a central bend and bends at its extremities thereby increasing the comfort with which the bar may be rested on the shoulders at the back of the neck of the user and facilitating grasping of the bar at its extremities.

U.S. Pat. No. 3,820,781 illustrates an essentially straight bar which has a semi-circular yoke at its mid-section for more comfortable resting at the back of the neck and on the shoulders of the users. FIG. 1 of the '781 patent illustrates the traditional use in the prior art of a straight bar such as a broomstick or a weight bar.

U.S. Pat. 4,257,591 illustrates an exercise bar which again is essentially straight but which contains at its extremities specially configured hand grasping members or handles.

In all of the patents noted above, the exercise bar is carried on top of the shoulders and behind the neck of the user. Further, in all of the above devices, the user grasps the bar at or near its extremities or rests the forearms on the top of the bar at or near such extremities. In both cases the arms are extended.

U.S. Pat. No. 4,863,158 illustrates an exercise bar having a central semi-circular portion for more comfortable resting of the bar behind the neck, and on the shoulders, of the user with forwardly extending handles for grasping by the user somewhat inwardly from the extremities of the bar. This bar also contains facilities for adding weights to the extremities thereof for increasing the mass carried and manipulated by the user.

U.S. Pat. No. 4,603,854 shows a trunk twist exercise device in which a straight bar having handles near its extremities also includes large area blades at either extremity. This bar is apparently rested across the shoulder blades of the user, a slightly curved portion permitting the bar to pass around the shoulders. The handles are grasped by the user with the arms nearly fully extended and trunk twists are undertaken. The blades increase wind resistance and thereby increase the force necessary to alternately twist the upper torso.

In none of the above described prior devices are the shoulders of the user locked together. Specifically, the shoulders may move independently to some extent. The use prior art torso twist bars thus permits the user to gain an "advantage" and to "cheat" in such a way as to not most efficiently exercise the abdominal and oblique muscles.

Further, prior art devices as described above, permit the arms, especially when outstretched, to "pull" the upper torso around, once again permitting the user to "cheat" and to not work the muscles of interest in the most efficient manner. The prior art devices are also to some extent uncomfortable to use. Specifically, if the mass of the bars is more than minimal, the weight thereof resting on the shoulders and behind the neck can produce muscle tension, strain and fatigue.

One object of the present invention is the elimination or amelioration of the disadvantages of the exercise bars of the prior art.

SUMMARY OF THE INVENTION

With the above and other objects in view, the present invention relates to an exercise device for toning the abdominal and oblique muscles and reducing the waist by facilitating efficient twisting of the upper human torso. The device comprises a generally semi-circular band-like member made of a suitable material such as wood or plastic. The internal diameter of the internal curvature of the member is approximately 26–27 inches which permits it to be used by a wide variety of users. The two extremities of the device mount handles which are grasped by the hands of the user. The handles extend toward each other across the front of the user. The dimension and configuration of the device and the location of the handles forces the hands to be located close to the upper torso of the body when the inner curvature of the device is held against the back across or slightly below the shoulder blades and curves around the sides of the users body.

In preferred embodiments, the member has a triangular cross-section, with one side of the triangle resting against the user's back in use. This side may also contain padding or the like to increase comfort during use. The triangular cross-section provides strength to the device. At the mid-point of the device, there may be a hinge or hinge-like member which permits the device to be folded for easy storage. The handles may be covered with a fabric or other material to provide a good, sure grip by the hands. The device may also contain a number of holes formed through the for carrying weights. Such weights increase the mass of the member and the force necessary to both start and stop the twisting motion thereby increasing the beneficial effects on the user's muscles.

In use the device is carried and held across the user's back at or below the shoulder blades. This avoids the user having to bear weight on his shoulders. Further, the semi-circular configuration of the device and the location of the handles causes the user's arms when the handles are grasped with the hands to be held close to the body and not extended outwardly. This decreases arm fatigue such as may be caused in prior art straight or semi-straight bars. Because of the location of the arms and the hands, the shoulders of the user are, in effect, locked together, causing the shoulders, as well as the rest of the upper torso of the user, to rotate as a unit thus discouraging "cheating". Further, with the arms close to the body they may not be used to "pull" the upper torso around during twisting. This, it has been found, provides a more efficient and more powerful twisting action. The device, in effect, locks all of the significant portions of the upper torso—arms, hands and shoulders—together for a more efficient twisting exercise motion.

DETAILED DESCRIPTION

Figures 1, 2:
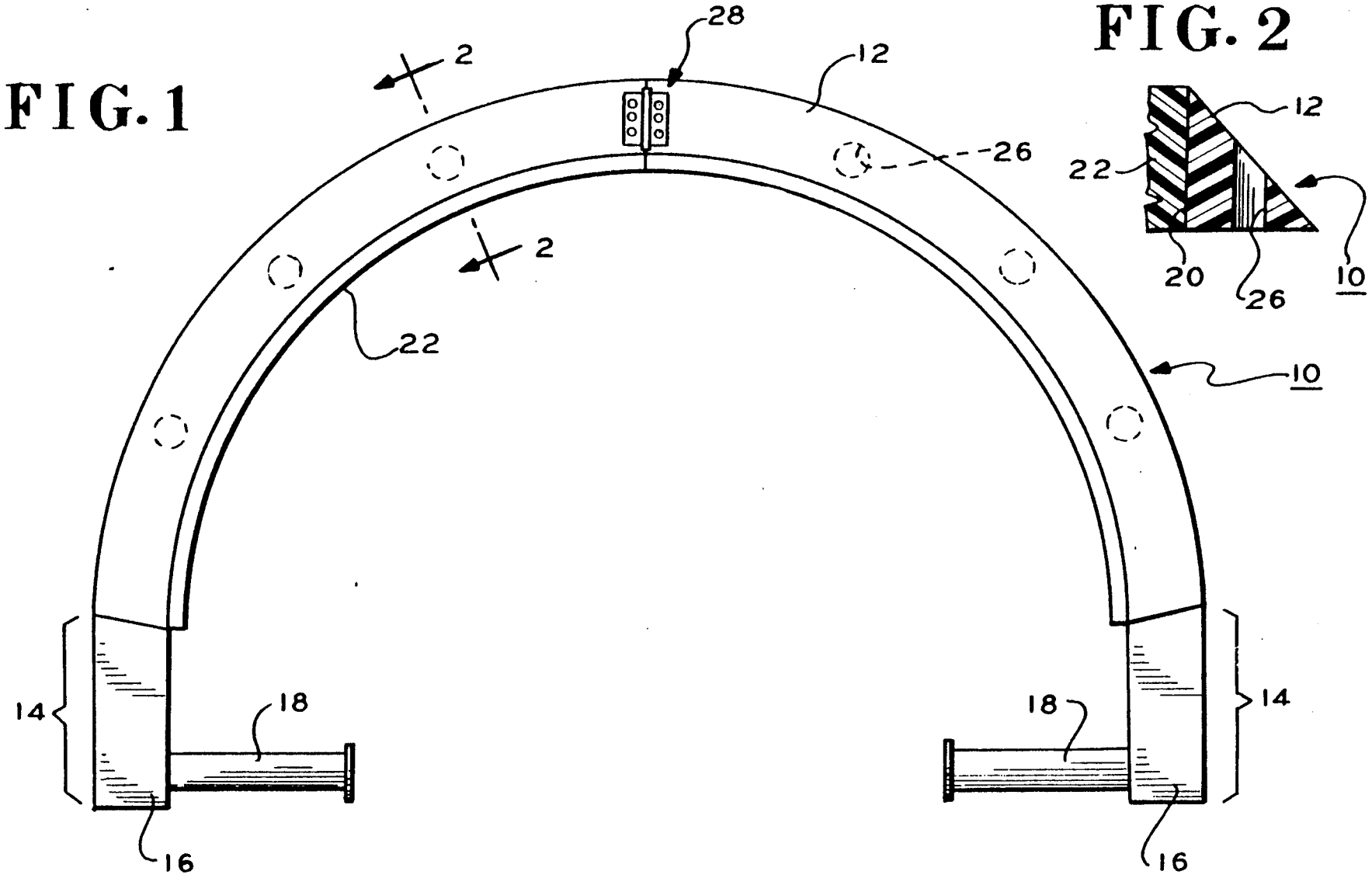
FIG. 1 is a plan view of one embodiment of a body exercise device according to the present invention.
FIG. 2 is a sectional view of the device of FIG. 1 taken along line 2—2.

Referring first to FIG. 1, there is shown in accordance with the present invention a device 10 for permitting the user to perform efficient upper trunk twists in order to exercise the abdominal and oblique muscles and to reduce the waist.

As viewed from the top in FIG. 1 the device 10 comprises a member 12 which may be generally planar and which assumes the configuration of a semi-circle, although other configurations, such as triangular, square or elliposoidal, may be used. The member may be made of wood, plastic, metal or other suitable material. At or near the extremities of the semi-circle, the device 10 may assume a noncircular contour, as shown at the portions 14, and terminate at ends 16.

Attached to, or formed integrally with the ends 16 of the member 12 are handles 18 which extend toward each other generally along or adjacent to a diameter of the semi-circular member 12. The distance between the portions 14 of the member 12 is approximately 26 to 27 inches, though this distance is variable.

Figure 4A:
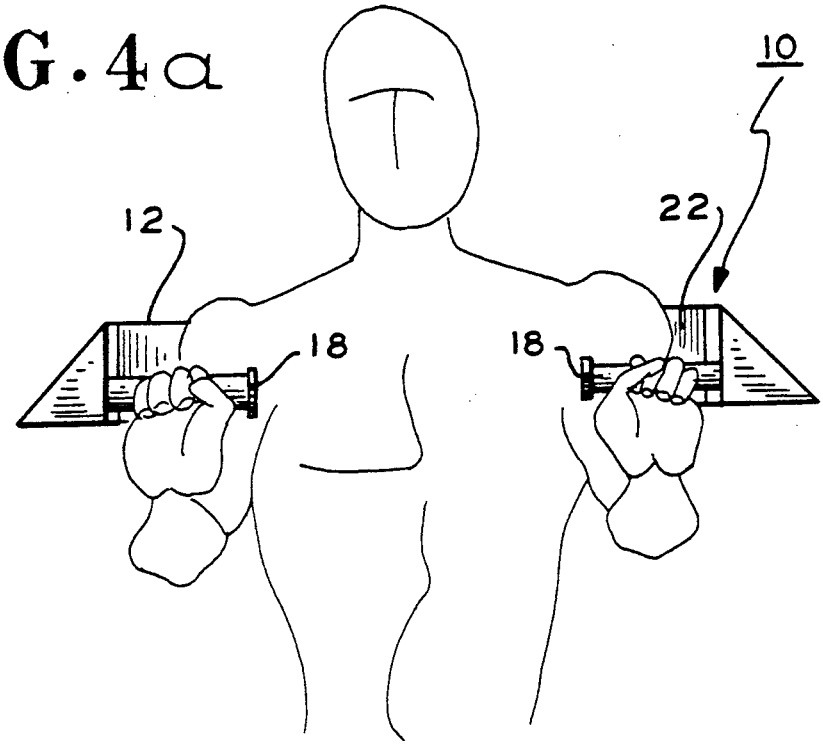
FIGS. 4*a*, 4*b* schematically depict the use of the device of FIGS. 1–3.
Figure 4B:
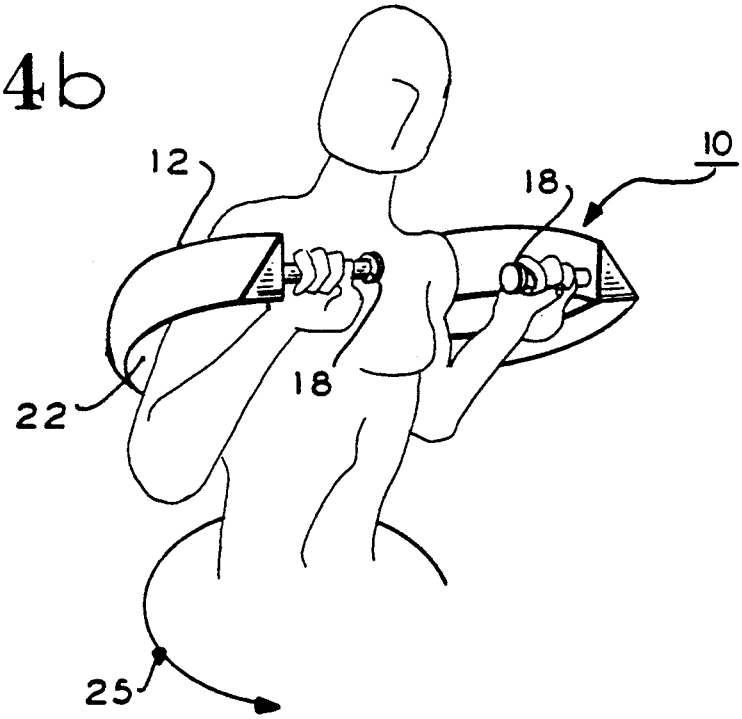

As illustrated in FIG. 4, the device 10 is intended to be held across the back at or near the shoulder blades so that the ends 16 and the handles 18 are positioned slightly to the front of the user. It has been found that with the distance between the ends 16 being approximately 26 to 27 inches, most users of a variety of sizes and weights can be accommodated and may utilize the device 10, while realizing its benefits.

Figure 3:
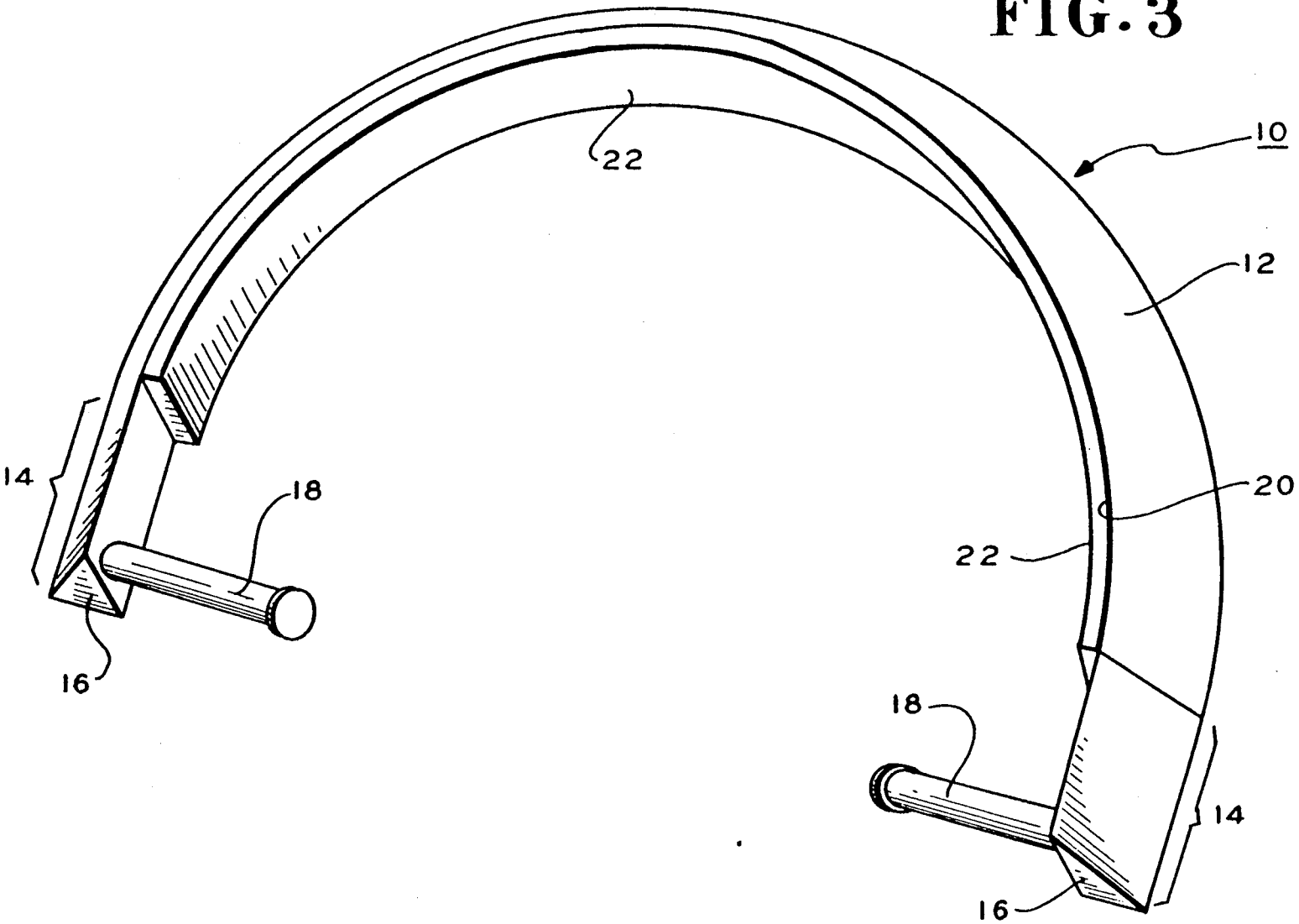
FIG. 3 is a perspective view of another embodiment of the device shown in FIG. 1.

The material from which the member 12 is manufactured may be sufficiently robust and rigid so that the member 12 is thin and planar. If it is desired to add structural strength to the unit, it may, as shown in FIGS. 2–4, have a triangular cross-section with one leg 20 of the triangle acting as a surface 20 which rests against the back of the user. As shown in FIG. 2, the surface 20 may include padding 22 which rests against the back of the user when the device 10 is being utilized.

The width dimension of the member 12 may be approximately 2 inches, the height dimension may be about 3 inches, and the hypotenuse may be about 3.2 inches. A handle length of approximately 6 inches has been found acceptable.

As already noted, in use the device 10 is positioned so that the surface 20 or the padding 22 rests across the back of the user either on or near the shoulder blades and so that the ends 16 and the handles 18 are forward of the user. The user grasps the handles 18 and in so doing, via appropriate selection of the distance between the portions 14, the arms are bent and are held close to the upper torso (See FIGS. 4*a* and 4*b*). Torso twisting (arrow 25 in FIG. 4*b*) is then initiated with the beneficial effects earlier noted. In addition to the device 10 maintaining the arms inwardly, the shoulders are locked together and move in unison. This causes a more efficient performance of torso twisting. The compact design of the device 10 and the fact that the arms are kept inwardly during use permits the user to utilize the device both while in crowded quarters and, while riding an exercise cycle. The use of bars and the like in similar circumstances would be difficult if not impossible.

The member 12 may contain a plurality of holes or pockets 26 for holding and retaining small cylindrical weights (not shown). The temporary or permanent addition of these weights to the device 10 adds mass thereto to increase the effort required to both initiate and stop torso twisting and thereby increases the muscular improvement of such exercise.

The device 10 may also be folded. Specifically, the member 12 may include one or more hinges 28 about which the member 12 may be folded and unfolded. Such hinges would permit the device to be folded for storage in a small volume.

If desired, the handles 18 may be covered with leather, cord, cloth or other material to enhance the gripability thereof.

Those skilled in the art will appreciate that changes and modifications may be made of the foregoing described device without departing from the scope of the claims which follow.

I claim:

1. An exercise device for facilitating and enhancing trunk rotation exercises, which comprises:

an elongated member formed generally into a semi-circle so that the distance between its ends and generally along or near a diameter is sufficient to permit the inside curvature of the member to rest on and along the upper portion of a human back with the ends extending slightly to the front of a human laterally of the upper arms; and hand graspable handles on each end of the member, the handles extending toward each other and remain in a fixed spaced relationship during exercise so that when grasped by the hands with the member resting on the back, the arms are bent with the elbows down and are held in close proximity to the sides of the torso, and so that the shoulders are essentially locked together for conjoint twisting with the torso.

2. A device as in claim 1, wherein:

the distance between the ends is about 26–27 inches.

3. A device as in claim 1, wherein:

the member has a surface along the inside curvature which rests on the human back.

4. A device as in claim 3, which further includes: padding on the surface.

5. A device as in claim 1, which further comprises: hinge means for permitting the member to be folded for storage and unfolded for use.

6. A device as in claim 1, which further comprises means for selectively mounting weights to the member.

7. A device as in claim 1, wherein:

with the inside curvature across or near the shoulder blades and the hands grasping the handles, no portion of the upper body significantly protrudes beyond the vertical envelope defined by the device.

* * * * *